United States Patent [19]

Olsson

[11] 4,109,348

[45] Aug. 29, 1978

[54] SAFETY CLIPS

[75] Inventor: Rune Olsson, Hollviksnas, Sweden

[73] Assignee: Produnik AB, Malmo, Sweden

[21] Appl. No.: 806,443

[22] Filed: Jun. 14, 1977

[51] Int. Cl.[2] ..... B42F 3/00; B42F 13/06

[52] U.S. Cl. ..... 24/153; 24/87 TB; 402/15; 402/8

[58] Field of Search ..... 24/153 R, 87 TB, 153.1, 24/DIG. 28, 87 R; 402/14, 15, 8

[56] References Cited

U.S. PATENT DOCUMENTS

| | | | |
|---|---|---|---|
| 2,307,295 | 1/1943 | Pettit | 24/87 TB |
| 2,352,407 | 6/1944 | Potts | 24/153 R |
| 3,501,815 | 3/1970 | Dreux | 24/153.1 |

FOREIGN PATENT DOCUMENTS

| | | | |
|---|---|---|---|
| 1,008,256 | 5/1957 | Fed. Rep. of Germany | 402/14 |
| 1,128,402 | 4/1962 | Fed. Rep. of Germany | 402/14 |
| 170,725 | 5/1906 | Fed. Rep. of Germany | 24/153 R |
| 243,783 | 1/1947 | Switzerland | 402/14 |
| 686,388 | 1/1953 | United Kingdom | 402/14 |
| 1,419,426 | 1/1973 | United Kingdom | 402/14 |
| 848,684 | 9/1960 | United Kingdom | 402/14 |

*Primary Examiner*—Bernard A. Gelak

*Attorney, Agent, or Firm*—Lerner, David, Littenberg & Samuel

[57] ABSTRACT

A clip is provided for maintaining sheets in bundle form, the sheets having holes formed therein, and includes a resilient member and an opening formed adjacent each end of the resilient member. A shoulder member extends from the outer periphery of the openings and is adapted to engage the outer periphery of the holes of the sheets. An end lug is connected to each of the shoulder members and extends in a plane parallel to the resilient member. In this manner, to insert the clip within the holes of the sheets, the resilient member is flexed so that the end lugs may be inserted into the holes of the sheets for maintaining the sheets in bundle form.

3 Claims, 10 Drawing Figures

SAFETY CLIPS

FIELD OF THE INVENTION

The present invention relates generally to clips or fasteners, and specifically to clips for maintaining sheets in bundle form, such as sheets of paper, having holes formed therein.

SUMMARY OF THE INVENTION

Briefly, in accordance with the principles of the present invention, an improved clip or fastener is provided for maintaining sheets in bundle form, such as sheets of paper, having spaced-apart holes formed therein. Once the sheets are held together by the clip of the present invention, they may be inserted into a cover having a fork mechanism of similar device, having forks spaced apart according to the accepted standards. In addition, the clips of the present invention can be shaped to be used with the two upper holes, or alternatively, with the two lower holes in the sheets. Moreover, the clip can be manufactured from any suitable material, such as plastic, and may be made of any suitable color.

The clip of the present invention includes a resilient member and an opening formed adjacent each end thereof. A shoulder member extends from the outer periphery of the openings of the resilient member, and such shoulder members are adapted to engage the outer periphery of the holes of the sheets. In addition, an end lug is connected to each of the shoulder members and extends in opposite directions and away from each other in a plane parallel to the resilient member. In this manner, the resilient member may be flexed so that the end lugs may be inserted into the holes of the sheets for maintaining the sheets in bundle form.

BRIEF DESCRIPTION OF THE DRAWINGS

Further objects, features, and advantages of the present invention will become apparent upon the consideration of the following detailed description of presently-preferred embodiments when taken in conjunction with the accompanying drawings, wherein.

DETAILED DISCUSSION OF PREFERRED EMBODIMENTS OF THE INVENTION

Figure 1:
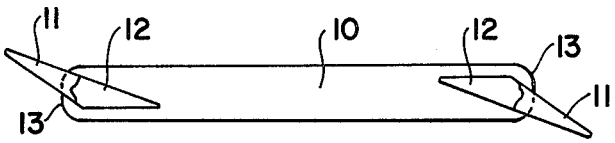
FIG. 1 is a plan view of a clip embodying the principles of the present invention.

Referring now to FIG. 1, there is shown a clip or fastener, embodying the principles of the present invention, for maintaining sheets in bundle form, such as sheets of paper, having holes formed therein. The clip includes a strip 10 of resilient plastic material, so that the strip can be flexed and thereafter resume its original planar shape. At the ends of the strip 10, there are end lugs 11 which, in the embodiment according to FIGS. 1 through 4, are punched and bent out of the strip 10 and are angled in opposite directions. As a result of the punching out of the lugs 11, openings 12 are formed in the strip 10. The ends 13 of the strip 10 project out over lugs 11 so that ends 13, together with lugs 11, define a notch 14 at each end of the clip.

It will be understood that the distance between notches 14 is controlled by the distance between the holes in the paper sheets to be clipped. Specifically, the distance between the notches 14 is equal to the distance between the outer periphery of the holes of the paper sheets, such as a paper sheet having four holes spaced apart by the standard distance. When the lugs 11 of the clip are inserted into the holes of the sheets, the outer periphery of the holes is accommodated in and engaged by notches 14, so that a number of sheets of paper which are attached by means of the clip according to the present invention are maintained together in the notch 14 between each lug 11 and the adjacent end 13.

It should also be noted that a fork mechanism of the standard type, spaced apart by the standard distance, can be inserted through the openings 12 of the clips in accordance with the present invention when the clips are holding a bundle of papers together. Therefore, the papers can be maintained together by the clips while they are in the fork mechanism of the cover, so that the clips also form a hole reinforcement for the papers.

Figure 2:
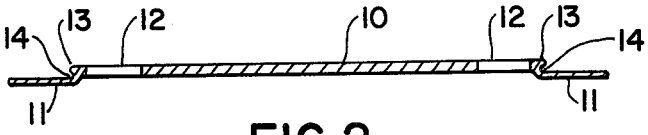
FIG. 2 is a cross-sectional view of the clip of FIG. 1.
Figure 3:
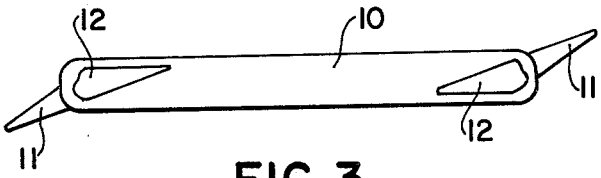
FIG. 3 is a bottom plan view of the clip of FIG. 1.
Figure 4:
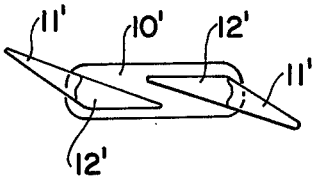
FIG. 4 is a plan view of an alternative clip in accordance with the present invention which is intended to be inserted in the two upper holes or two lower holes in papers having four holes.
Figure 5:
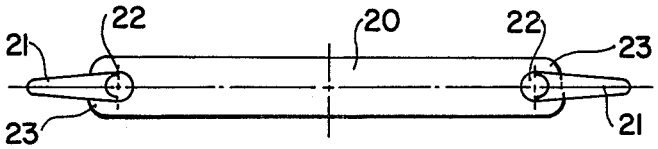
FIG. 5 is a plan view of an alternative form of a clip in accordance with the present invention.
Figure 6:
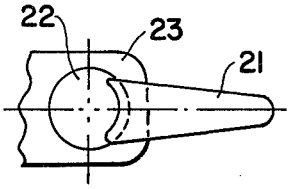
FIG. 6 is an enlarged view in detail of the end lug of FIG. 5.
Figure 7:
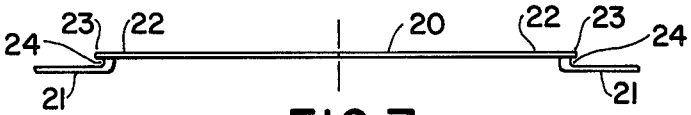
FIG. 7 is a side elevational view of the clip shown in FIG. 5.
Figure 8:
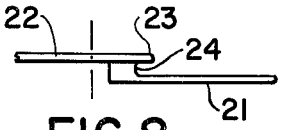
FIG. 8 is an enlarged view in detail of the end lug of FIG. 7.
Figure 9:
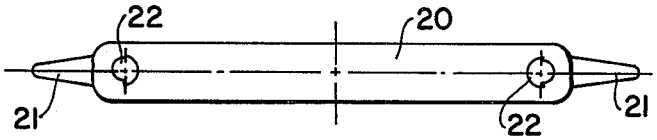
FIG. 9 is a bottom plan view of the clip shown in FIG. 5.
Figure 10:
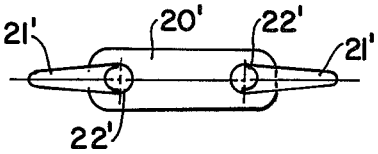
FIG. 10 illustrates an alternative form of a clip in accordance with the present invention intended for insertion in the two upper holes or two lower holes in paper sheets having four holes.

Referring to the embodiment of FIG. 4, it is essentially of the same construction as the clip shown in FIGS. 1 through 3, with like parts being designated by primed reference numerals. However, it is of a shorter length so that it may be introduced into the two upper holes or two lower holes of sheets to be bundled together.

Referring to the embodiments shown in FIGS. 5 through 10, the clips are injection molded from suitable plastic material. They are essentially similar to the embodiments shown in FIGS. 1 through 4 and include resilient strip 20, lugs 21, openings 22, ends 23, and notches 24. However, as a result of the injection molding, it is possible to more carefully shape the transition region or shoulder member or notch 24 between lug 21 and strip 20 which forms the abutment for engaging the sheet edges forming the holes of the sheets of paper. As will be seen most clearly in FIGS. 5 through 8, the abutment surface 24 is circular in shaped or arc-shaped. This arc-shaped abutment surface 24 has a radius substantially equal to the radius of the holes in the paper sheets and allows the paper sheets to be clamped together with a particular force and without damaging the holes in the paper sheets.

Also, it will be noted that in the embodiments of FIGS. 5 through 10, the lugs 21 are not angled as in the embodiments of FIGS. 1 through 4 but extend in a direction parallel to the longitudinal axis of the clip.

Of course, it will also be understood that by properly dimensioning the height of abutment surface or notch 24, the clip 20 of the present invention may be manufactured for locking and clamping the desired number of sheets.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

I claim:

1. A clip for maintaining sheets in bundle form, said sheets having spaced-apart holes formed therein, comprising:

a resilient member movable between a normal planar position and a non-planar flexed position, a shoulder member extending from a point adjacent each end of said resilient member, and in a direction substantially perpendicular to the plane of said resilient member, said shoulder members each having a sheet-abutting surface, an end lug connected to each of said shoulder members and extending in a plane parallel to the planar position of said resilient member for insertion into the spaced-apart holes of said sheets upon flexing of said resilient member, said sheet-abutting surfaces being spaced apart a distance such that they function to pressingly engage the sheet edges forming the spaced-apart holes of said sheets when said resilient member returns to its normal planar position, each of said end lugs being spaced from said resilient member to define said sheet-abutting surface therebetween for engaging the sheet edges forming the holes of said sheets and thereby maintain the sheets in a stacked relationship, and said resilient member further including openings formed therein adjacent each end thereof, one of said shoulder members extending from the outer periphery of each of said openings, and said end lugs connected to said shoulder members extending in opposite directions and extending away from each other, said openings being spaced apart a distance substantially equal to the distance of the spaced-apart holes of said sheets, whereby said holes and said openings are in substantial alignment and are adapted to receive fork members extending therethrough, and whereby said resilient member functions as a reinforcement device for said sheets.

2. A clip according to claim 1, wherein said sheet-abutting surfaces are arc-shaped and are adapted to engage the outer periphery of the holes of said sheets.

3. A clip according to claim 1, wherein said lug members extend beyond the respective ends of said resilient member.

* * * * *